United States Patent [19]

Vandenbark et al.

[11] 4,136,410

[45] Jan. 30, 1979

[54] SPRING DECK FOR SEATING STRUCTURES

[75] Inventors: Thomas E. Vandenbark, Martinsville, Ind.; John H. Patrick, Carthage, Mo.

[73] Assignee: Flex-O-Lators, Inc., Carthage, Mo.

[21] Appl. No.: 855,826

[22] Filed: Nov. 30, 1977

[51] Int. Cl.[2] ..... A47C 27/22

[52] U.S. Cl. ..... 5/190; 5/191; 5/354; 297/452

[58] Field of Search ..... 5/190, 191, 259 R, 259 B, 5/351, 354; 297/452

[56] References Cited

U.S. PATENT DOCUMENTS

| | | | |
|---|---|---|---|
| 3,195,955 | 7/1965 | Richardson et al. | 5/191 |
| 3,733,625 | 5/1973 | Platt et al. | 5/191 |
| 3,773,310 | 11/1973 | Crosby | 5/259 B |

*Primary Examiner*—Casmir A. Nunberg

*Attorney, Agent, or Firm*—John A. Hamilton

[57] ABSTRACT

A spring deck for seating structures consisting of a wire fabric sheet adapted to be applied to cover an open seating frame, and consisting of a pair of normally straight side spring wires secured at spaced intervals along their lengths to the side legs of the frame, and closely spaced, normally straight spring cross wires extending between and connected at their ends to the side wires.

9 Claims, 3 Drawing Figures

SPRING DECK FOR SEATING STRUCTURES

This invention relates to new and useful improvements in spring decks for upholstered seating, and relates particularly to a device for providing a resiliently yieldable deck for supporting upholstery padding material in furniture or automotive seating, either in the seat bases or seat backs. It may also be used to provide mattress supports in beds, cots or the like. p The principal objects of the present invention is the provision of a spring deck which, while providing fully acceptable softness and depth of yieldability for most purposes, completely eliminates any necessity for using coil springs, zig-zag or serpentine springs, or any other of the specially configurated wire forms commonly employed for this purpose, thereby providing valuable simplification and economy. Generally, this object is accomplished by the provision of a wire fabric sheet adapted to be applied to cover an open deck frame, the fabric consisting of a pair of parallel, normally straight spring side wires adapted to lie adjacent the side legs of the frame and a series of closely spaced, normally straight spring cross wires extending between and secured at their ends to said side wires, and means for securing each of said side wires to its associated frame side leg at spaced apart intervals along its length, the points of attachment of one side wire being longitudinally staggered relative to the points of attachment of the other side wire. Thus when the deck surface defined by the cross wires is loaded transversely to the plane of the frame, as in normal usage, the side wires may yield or bow transversely inwardly to permit longitudinal movement of the cross wires, which in alternate sets move in relatively opposite directions, thereby permitting resilient yielding of the deck transversely of its plane.

Another object is the provision of a spring deck of the character described having novel provisions for securing the wires forming the fabric sheet in proper relation to each other, and to the frame, during the relative movements thereof occurring in usage.

Other objects are extreme simplicity and economy of construction, and efficiency and dependability of operation.

Figure 1:
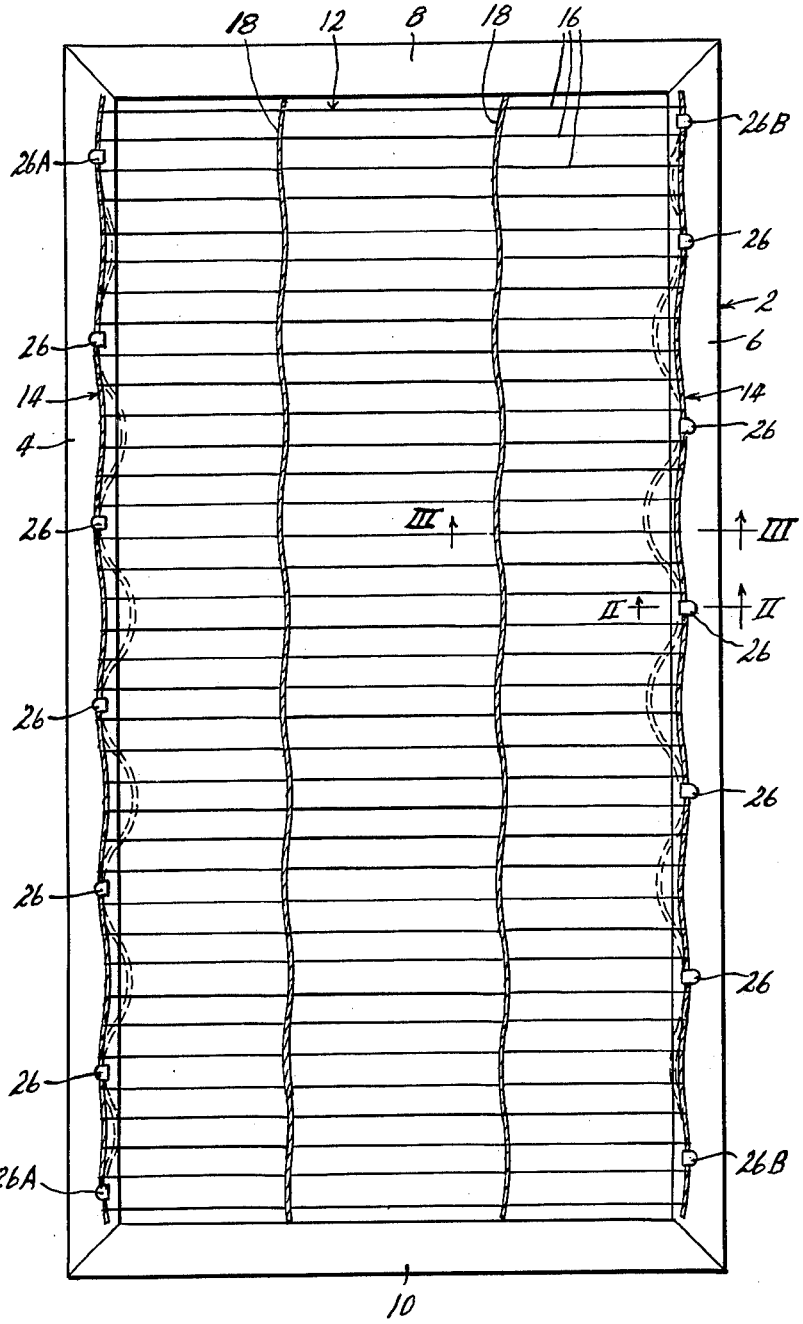
Figure 3:
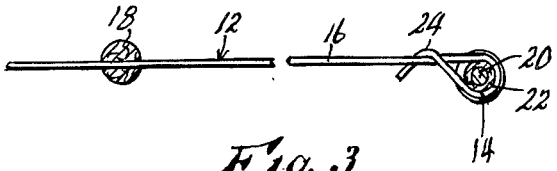
Figure 2:
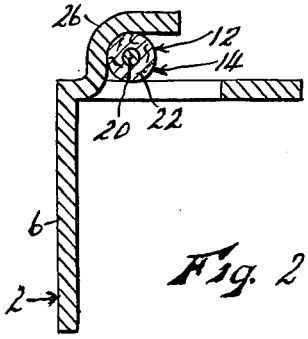

With these objects in view, as well as other objects which will appear in the course of the specification, reference will be had to the accompanying drawing, wherein:

FIG. 1 is a top plan view of a spring deck embodying the present invention, shown in a normal at-rest position in solid lines, and showing the side wires in dotted lines in a position assumed thereby when the deck is loaded, FIG. 2 is an enlarged, fragmentary sectional view taken on line II—II of FIG. 1, and FIG. 3 is an enlarged, foreshortened, fragmentary sectional view taken on line III—III of FIG. 1.

Like reference numerals apply to similar parts throughout the several views. The numeral 2 applies to a rigid frame, which as shown is rectangular in form and formed of angle iron, having side legs 4 and 6, and end legs 8 and 10. It may constitute the frame of a seat base or seat back, the frame of a bed or cot, or any other furniture or seating piece in which a resiliently yieldable spring deck for supporting upholstery padding material, cushions, mattresses or the like is desired. Its specific form is optional, as is its size and structural material, so long as it has side legs 4 and 6 which are generally parallel. Mounted in frame 2 to substantially cover it is a wire fabric sheet designated generally by the numeral 12.

Wire fabric sheet 12 comprises a pair of parallel side strands 14 which respectively overlie side frame legs 4 and 6, a continuous series of closely spaced apart cross wires 16 extending between side strands 14 at right angles thereto, and secured at their ends to said side strands, and one or more intermediate strands 18 extending parallel to side strands 14 and spaced therebetween. As best shown in FIGS. 2 and 3, each side strand 14 consists of a core 20 comprising a relatively heavy spring wire, having a covering sheath 22 of soft, indentable material such as twisted paper, soft plastic or the like. Cross wires 16 are also formed of spring steel, though of substantially lighter gauge than core wires 20 of the side strands, and each is secured at its ends to the side strands, as best shown in FIG. 3, by wrapping it tightly first about sheath 22 of the side strand, in deeply indenting relation thereto, then twisting it around its standing portion as indicated at 24. This type of connection is often referred to as a "knot." Intermediate strands 18 may also be formed of twisted paper, but without wire cores, so as to remain pliably flexible. Each of said intermediate strands is pierced by each of cross wires 16 at its point of intersection therewith. The wire fabric sheet may be partially or entirely coated with plastic to further enhance its structural integrity.

In one form of the invention, as shown in the drawing, the wire fabric sheet as just described is applied over frame 2 by engaging each of its side strands 14, at spaced apart points along the length thereof, behind hooks 26 struck out from the associated side frame leg 4 or 6. Said hooks open outwardly, and engage the associated side strand 14 intermediate a pair of adjacent cross wires secured to said side strand. Other types of hook fasteners, of fasteners other than hooks, could be used if desired. Along most of the length of the side strands, hooks 26 are spaced regularly, including at least several of cross wires 16 between adjacent hooks, and the hooks of each frame side leg are staggered with respect to the hooks of the other frame side leg, so that each hook is disposed midway between the closest hooks of the opposite frame leg, considered in a direction longitudinal to the side strands. At the extreme ends of the side strands, however, the endmost opposed hooks 26 of the two frame side legs, further designated as 26A and 26B, are spaced apart longitudinally of the side strands only by the spacing between two successive cross wires 16. This provides better support for the end portions of the wire fabric sheet, and even the short space between hooks 26A and 26B, longitudinally of the side strands, permits the side strands to be engaged therein, despite the longitudinal inextensibility of the cross wires 16 extending therebetween, provided that the end connections to both sets of hooks 26A and 26B are made first. This allows the fabric sheet to be distorted somewhat, if necessary, in order to make these end connections. Thereafter, the side strands may be engaged in the intermediate hooks. Preferably, the lateral spacing between the hooks of the respective side frame rails is slightly greater than the normal lateral spacing between side strands 14 of the fabric, in order that said side strands are forced into a slightly sinuous form when the fabric is applied to the frame as just described, as shown in solid lines in FIG. 1. The spring tension of the wire cores of the side strands then hold the fabric firmly in assembly with the frame. It will be understood that in usage the spring deck, the load surface of which is defined in skeleton form by cross wires 16, is normally covered by layers of upholstery padding applied thereover, or by pads or mattresses laid thereover.

In operation, it will be seen that when the deck is loaded as in normal usage, by the application of weight to cross wires 16 of fabric 12 within frame 2, transversely to the plane of the frame, cross wires 16 are placed under tension. However, these wires are substantially inextensible in length, and therefore their tension exerts lateral forces on side strands 14, tending to pull said side strands closer together. The side strands are laterally yieldable, and hence bow resiliently inwardly between adjacent hooks 26 of the frame, as shown in dotted lines in FIG. 1. This bowing increases the effective length of each cross wire, as measured by the distance between the frame hooks 26 to which it is effectively connected, and hence permits the cross wires to yield transversely to the plane of the frame to provide a resilient yield of sufficient "depth" to provide a fully acceptable degree of comfort. The yield may also be cushioned by the resilient stiffness of cross wires 16 themselves, provided they are of sufficiently heavy gauge for this purpose.

It might at first appear that the bowing of the side strands 14 between hooks 26 requires an increase in the length thereof, which is not possible so long as they are loaded beneath their elastic limits. However, while the degree of bowing is perhaps exaggerated in the drawing, for purposes of clarity, it has been found that so long as the side strands are applied to the frame without longitudinal pre-tensioning, as is here the case, a greater degree of bowing than would theoretically seem possible readily occurs. Also, the intervals between adjacent hooks 26 may be, and preferably are, slightly decreased, in comparison to the spacing between the interstices of the fabric into which they are to be inserted, in order to introduce a degree of "slack" into the side strands, thereby increasing the possible degree of bowing. Furthermore, due to their length, the vertical yield of the central portions of cross wires 16 is greater than the transverse yield of the side strands. As a result of all of these factors, a deck having sufficient depth of yield for most purposes can be obtained with the present structure, although the structure is nevertheless perhaps best adapted for relatively firm decks. The use of firm decks is the present trend in automotive seat backs and certain other usages.

The staggering of the hooks 26 of the respective side frame legs is essential. Except at the extreme ends, it permits all of the cross wires to yield equally, so that the side strands remain generally parallel in the sense that directly opposite points thereof remain equidistantly spaced apart at all times, as necessitated by the equal lengths of all of the cross wires. If the hooks were aligned rather than staggered as shown, the cross wires closest to the hooks would be relatively unyeldable, while those more remote from the hooks would be relatively easily yieldable, thus imparting an uncomfortable, transversely "ribbed" effect to the deck. At the extreme ends, the yieldability of the endmost cross wires is in fact inhibited by the close longitudinal spacing of hooks 26A and 26B, but yieldability in these zones is not desired, both because these zones are not normally loaded in use, and also because they are closely spaced to the unyieldable end legs 8 and 10 of the frame.

It will be apparent that a greater spacing between the hooks 26 will tend to produce a softer, more yieldable deck, by permitting a greater degree of bowing of the side strands, while a closer spacing of the hooks will tend to produce a firmer deck. Depending on the stiffness of the core wires 20 of the side strands and certain other factors, a spacing of about 6 inches between adjacent hooks has been found generally satisfactory, but this of course a matter of proper engineering and selection.

Certain other features of the invention are deemed worthy of special note. The insertion of each hook 26 between adjacent cross wires 16, together with the extremely tight connection of the cross wires to the side strands by the described knotting, prevents any appreciable longitudinal slippage of the side strands through the hooks. This slippage, if it could occur, would permit excessive inward bowing of the side strands at a point aligned with the point of application of a localized load to the deck, and hence permit excessive localized yielding of the deck at that point. The firm affixation of the cross wires to the side strands by the described knotting also prevents said cross wires from slipping along the side strands when the latter become bowed in usage, thus preserving the integrity of the general spatial arrangement of said wires. The sheaths 22 of the side strands, and the fact that they are deeply indented by the cross wires knoted thereabout, provide the necessary security of the wire connections. The sheaths also have another function in that they prevent the unpleasant rubbing or grating "wire noises" which would otherwise occur both where the side strands engage in the hooks 26, and also at the connections of the cross wires to the side strands. Intermediate strands 18 preserve the proper spacing between cross wires 16 at points intermediate the side strands, thereby preventing disarrangement of the cross wires and preserving the desired continuity of padding support provided by the deck. As many of these intermediate strands as may be found necessary for this purpose may of course be used.

While we have shown and described a specific embodiment of our invention, it will be readily apparent that many minor changes could be made without departing from the spirit of the invention.

What I claim as new and desire to protect by Letters Patent is:

1. A spring deck for supporting padding material in seating or bedding structures, said deck comprising:
   a. an open rigid frame having generally parallel side legs,
   b. a wire fabric sheet substantially covering said frame and consisting of a pair of resilient, normally straight side wires disposed respectively adjacent the side legs of said frame, and a continuous series of closely spaced cross wires extending transversely between and secured at their ends to said side wires, and
   c. means connecting each of said side wires unyieldably to the adjacent side frame leg at spaced apart points along the length thereof, the points of attachment of one of said wires to its frame leg being staggered relative to the points of attachment of the other side wire to its frame leg to lie therebetween, considered longitudinally of said side wires.

2. A spring deck as recited in claim 1 wherein the points of attachment of one of said side wires to its frame leg are uniformly spaced apart, and are disposed midway between the points of attachment of the other side wire to the other frame leg, considered longitudinally of said side wires.

3. A spring deck as recited in claim 2 with the addition of means operable to prevent longitudinal movement of each of said side wires at each of its points of connection to its associated frame leg.

4. A spring deck as recited in claim 2 wherein said connecting means joining each of said side wires to its associated frame leg, at each point of connection, cpmprises a hook connected to said frame leg and opening outwardly in the plane of said wire fabric sheet, said hook being engaged about said side wire between two successive cross wires of said sheet, said successive cross wires thereby serving to prevent longitudinal slippage of said side wires through said hook.

5. A spring deck as recited in claim 1 wherein said cross wires are also formed of resilient spring material, whereby together with said side wires to contribute further to the resilient stiffness of said deck.

6. A spring deck as recited in claim 1 wherein said connecting means joining each of said side wires to its associated frame leg, at each point of connection, comprises an outwardly opening hook connected to said frame leg and wherein each of said side wires is provided with an enclosing sheath of soft, indentable material, whereby to prevent grating metallic noises at the points of engagement thereof in said hooks.

7. A spring deck as recited in claim 1 wherein each of said side wires is provided with an enclosing sheath of soft, indentable material, and wherein each of said cross wires is knotted thereabout in indenting relation to said sheath, whereby slippage of said cross wires along said side wires is prevented.

8. A spring deck as recited in claim 1 with the addition of one or more intermediate strands disposed between and generally parallel to said side wires and being connected to each of said cross wires at its point of intersection therewith, said intermediate strands being pliably flexible.

9. A spring deck as recited in claim 1 wherein each of said side wires is provided with an enclosing sheath of soft, indentable material, wherein said means connecting each of said wires to its associated frame leg, at each point of connection, comprises a hook connected to said frame leg and opening outwardly from said wire fabric sheet in the plane of said sheet, said hook engaging about the sheath of its associated side wire intermediate a successive pair of said cross wires, wherein each of said cross wires is secured to each side wire by knotting it tightly about the sheath of the side wire in indenting relation to said sheath, and with the addition of one or more intermediate strands disposed between and generally parallel to said side wires, said intermediate strands being pliably flexible and connected to each of said cross wires at its point of intersection therewith.

* * * * *